US009890604B2

(12) United States Patent
Wood et al.

(10) Patent No.: US 9,890,604 B2
(45) Date of Patent: Feb. 13, 2018

(54) DEVICES AND RELATED METHODS FOR ACTUATING WELLBORE TOOLS WITH A PRESSURIZED GAS

(71) Applicant: Owen Oil Tools LP, Houston, TX (US)

(72) Inventors: Jeffrey D. Wood, Keller, TX (US); Kevin L. Baker, Hillsboro, TX (US); Matthew C. Clay, Burleson, TX (US)

(73) Assignee: OWEN OIL TOOLS LP, Houston, TX (US)

( * ) Notice: Subject to any disclaimer, the term of this patent is extended or adjusted under 35 U.S.C. 154(b) by 342 days.

(21) Appl. No.: 14/669,546

(22) Filed: Mar. 26, 2015

(65) Prior Publication Data

US 2015/0285019 A1 Oct. 8, 2015

Related U.S. Application Data

(60) Provisional application No. 61/975,585, filed on Apr. 4, 2014.

(51) Int. Cl.
*E21B 23/04* (2006.01)
*E21B 23/06* (2006.01)

(52) U.S. Cl.
CPC ..... *E21B 23/04* (2013.01); *E21B 23/065* (2013.01)

(58) Field of Classification Search
CPC ..... E21B 23/04; E21B 23/06; E21B 23/065; E21B 23/08; E21B 33/12; E21B 33/134; E21B 43/1185
USPC ..... 166/250.17, 105, 182, 153
See application file for complete search history.

(56) References Cited

U.S. PATENT DOCUMENTS 2,807,325 A * 9/1957 Webb ..... E21B 23/065 166/123
2,915,124 A * 12/1959 Chesnut ..... E21B 27/00 166/63
3,029,873 A * 4/1962 Hanes ..... E21B 23/065 166/120
3,208,355 A * 9/1965 Baker ..... E21B 23/06 137/70
3,220,480 A * 11/1965 Myers ..... E21B 23/065 166/120
3,244,232 A * 4/1966 Myers ..... E21B 23/065 166/212
3,266,575 A * 8/1966 Owen ..... E21B 23/065 166/120

(Continued)

OTHER PUBLICATIONS

PCT/US2015/023240—International Search Report dated Jun. 26, 2015.

*Primary Examiner* — Waseem Moorad
*Assistant Examiner* — Lamia Quaim
(74) *Attorney, Agent, or Firm* — Mossman, Kumar & Tyler, PC

(57) ABSTRACT

An apparatus for activating a wellbore tool may include a first sub, gas transfer sub, and a second sub. The first sub has an igniter that generates a flame output that ignites a power charge. The power charge generates a high pressure gas when ignited by the flame output. The gas transfer sub has a first end receiving a portion of the power charge, a longitudinal bore, and a plurality of flow passages radiating from the longitudinal bore. The flow passages provide fluid communication between the longitudinal bore and the first sub. The second sub includes a shaft having a first end connectable with the gas transfer sub.

10 Claims, 3 Drawing Sheets

(56) References Cited

U.S. PATENT DOCUMENTS 3,520,364 A * 7/1970 Bauer ..... E21B 43/243 166/260
3,669,190 A * 6/1972 Sizer ..... E21B 43/105 166/115
3,704,033 A 11/1972 Arnold
4,463,803 A * 8/1984 Wyatt ..... F22B 1/26 122/31.1
4,493,374 A 1/1985 Magee, Jr.
5,024,270 A 6/1991 Bostick
5,146,983 A 9/1992 Hromas et al.
5,159,145 A * 10/1992 Carisella ..... F42D 1/04 102/222
5,188,183 A 2/1993 Hopmann et al.
5,316,087 A 5/1994 Manke et al.
5,322,019 A 6/1994 Hyland
5,343,963 A 9/1994 Bouldin et al.
5,392,860 A * 2/1995 Ross ..... E21B 23/065 102/222
5,396,951 A 3/1995 Ross
5,465,628 A * 11/1995 Timmons ..... E21B 33/1243 73/864.34
5,908,365 A * 6/1999 LaJaunie ..... E21B 43/11852 102/206
6,055,213 A 4/2000 Rubbo et al.
6,257,331 B1 7/2001 Blount et al.
6,415,863 B1 7/2002 Hudson et al.
6,527,049 B2 3/2003 Metcalfe et al.
6,543,552 B1 4/2003 Metcalfe et al.
6,598,678 B1 7/2003 Simpson et al.
6,688,400 B2 2/2004 Metcalfe et al.
6,702,029 B2 3/2004 Metcalfe et al.
6,976,539 B2 12/2005 Metcalfe et al.
7,000,705 B2 2/2006 Buyers et al.
7,017,672 B2 3/2006 Owen, Sr.
7,124,830 B2 10/2006 Metcalfe et al.
7,168,497 B2 1/2007 Metcalfe et al.
7,308,944 B2 12/2007 Johnston et al.
7,431,335 B2 * 10/2008 Khandhadia ..... B60R 21/272 280/737
7,690,424 B2 4/2010 MacLeod et al.
7,717,183 B2 5/2010 Ezell et al.
7,878,242 B2 2/2011 Gray
8,016,026 B2 9/2011 Joseph
8,459,377 B2 6/2013 Moyes et al.
8,474,533 B2 7/2013 Miller et al.
8,534,367 B2 * 9/2013 Carisella ..... E21B 23/04 166/102
8,839,871 B2 9/2014 Wright et al.
8,893,786 B2 11/2014 Wright et al.
8,973,657 B2 3/2015 Miller et al.
9,169,705 B2 10/2015 Helms et al.
9,366,134 B2 6/2016 Walton et al.
9,388,669 B2 7/2016 Wright et al.
2005/0000692 A1 * 1/2005 Cook ..... E21B 23/04 166/300

* cited by examiner

DEVICES AND RELATED METHODS FOR ACTUATING WELLBORE TOOLS WITH A PRESSURIZED GAS

CROSS REFERENCE TO RELATED APPLICATIONS

This application claims priority from U.S. Provisional Application Ser. No. 61/975,585 filed on Apr. 4, 2014, the entire disclosure of which is incorporated herein by reference in its entirety.

BACKGROUND OF THE DISCLOSURE

1. Field of Disclosure

The present disclosure relates to an apparatus and method for actuating a downhole tool with a pressurized gas.

2. Description of the Related Art

During the construction, completion, recompletion, or work-over of oil and gas wells, there may be situations wherein one or more well tools may need to be mechanically actuated in situ. One known method for actuating a well tool is to generate a pressurized gas using a pyrotechnic charge and then convey the pressurized gas into a device that converts the pressure into mechanical energy, e.g., a piston-cylinder arrangement that converts the pressure into motion of a selected tool or tool component. In certain situations, the energetic material used to generate the pressurized gas may also produce debris in sufficient size and volume to partially or completely plug the passages that convey the pressurized gas to the actuator. In aspects, the present disclosure addresses the need for devices and methods for reducing the occurrence of plugging of these passages by the debris associated with deflagration of energetic materials.

SUMMARY OF THE DISCLOSURE

An apparatus for activating a wellbore tool may include a first sub having a first chamber and a second chamber; a igniter disposed in the first chamber, the igniter generating a flame output when ignited; a power charge disposed in the second chamber, the power charge generating a high pressure gas when ignited by the flame output; a gas transfer sub connectable with the first sub, the gas transfer sub having: a first end receiving a portion of the power charge, a longitudinal bore, and a plurality of flow passages radiating from the longitudinal bore, the plurality of flow passages providing fluid communication between the longitudinal bore and the second chamber of the first sub; and a second sub connectable with the gas transfer sub. The second sub may include a shaft having a first end connectable with the gas transfer sub, the shaft including: a passage in fluid communication with the longitudinal bore of the gas transfer sub and a face, and a piston positioned adjacent to the face, wherein a pressure chamber is formed between the shaft face and the piston is in fluid communication with the passage of the shaft.

The above-recited examples of features of the disclosure have been summarized rather broadly in order that the detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION OF THE DISCLOSURE

Figure 1A:
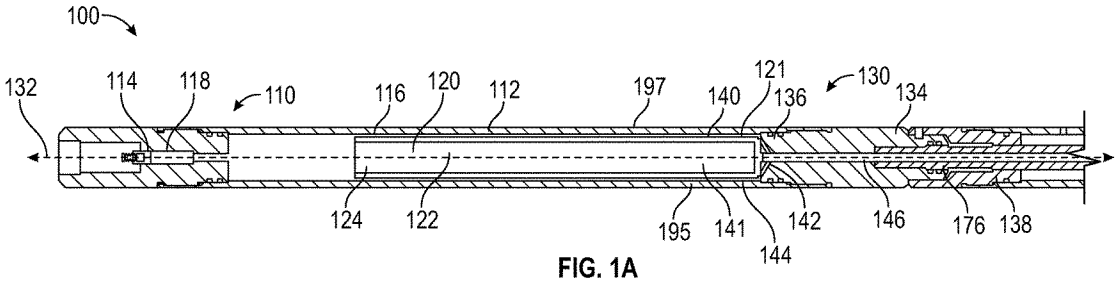
FIGS. 1A-B is a schematic sectional view of one embodiment of a gas energized well tool according to one embodiment of the present disclosure.

As will become apparent below, the present disclosure provides an efficient device for actuating well tools using pressurized gas. As will be appreciated, the present disclosure is susceptible to embodiments of different forms. There are shown in the drawings, and herein will be described in detail, specific embodiments of the present disclosure with the understanding that the present disclosure is to be considered an exemplification of the principles of the present disclosure, and is not intended to limit the disclosure to that illustrated and described herein.

Figure 1B:
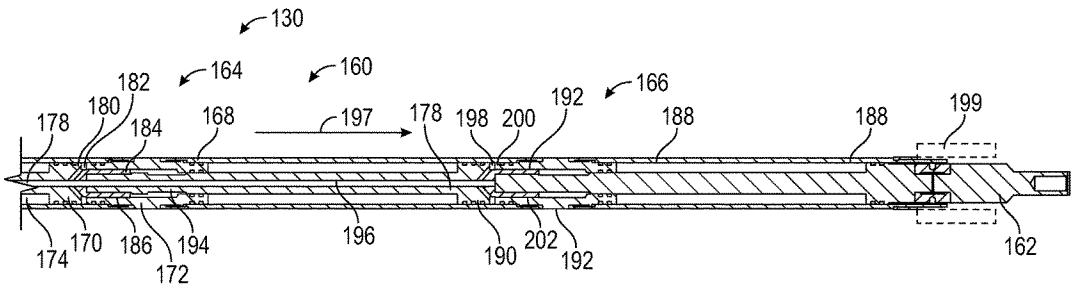

Referring FIGS. 1A-B, there is shown one embodiment of a well tool 100 according to the present disclosure. Although FIGS. 1A-B are depicted as separate drawings, they represent a continuous interconnected well tool 100. The well tool 100 may include an upper sub 110 (FIG. 1A), a gas transfer sub 130 (FIG. 1A), and a lower sub 160 (FIG. 1B). The well tool 100 may include an upper sub 110, a gas transfer sub 130, and a lower sub 160. The term "sub" is intended to generically refer to a section or a portion of a tool string. While a sub may be modular and use threaded connections, no particular configuration is intended or implied by the use of the term sub. Generally, the upper sub 110 generates a high-pressure gas that is conveyed by the gas transfer sub 130 to the lower sub 160. In this embodiment, the lower sub 160 uses the high-pressure gas to axially displace an actuator 162, which may be attached to a separate wellbore device (not shown). The lower sub 160 and the actuator 162 may be used to axially displace or otherwise move, shift, or load a separate wellbore device (not shown), which may be a packer, a swage, a bridge plug, etc.

Referring to FIG. 1A, in one configuration, the upper sub 110 includes a housing 112 that has a first chamber 114 and a second, larger chamber 116. An igniter 118 is positioned in the first chamber 114 and a power charge 120 is positioned in the second chamber 116. In one non-limiting embodiment, the igniter 118 may be a pyrotechnic device that generates a flame output when detonated by a suitable signal (e.g., electrical signal, hydraulic pressure, impact, etc.). The power charge 120 may be formed of an energetic material 122 that undergoes a low-order deflagration when ignited by the flame output of the igniter 118. The energetic material 122 may be housed in a tube 124 formed of a combustible material such as cardboard or non-combustible materials such as metals and plastic. The low-order deflagration generates a gas at sufficient pressure and with enough volume to energize the lower sub 160. The low-order deflagration may also produce debris in the form of solids, liquids, plasmas, gels, and mixtures thereof. Moreover, liquid debris may solidify soon after deflagration.

Figure 2:
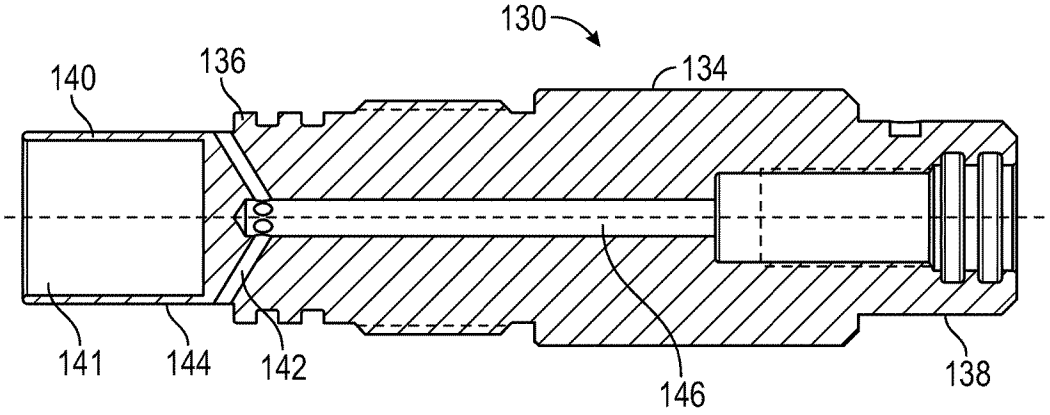
FIG. 2 is a sectional side view of a gas transfer sub in accordance with one embodiment of the present disclosure.

Referring to FIGS. 1A and 2, the gas transfer sub 130 transfers the gas generated by the upper sub 110 to the lower sub 160 (FIG. 1B). The gas transfer sub 130 may include a cylindrical body 134 that has an input end 136 and an output end 138. The input end 136 includes a cup 140 that projects into the second chamber 116. The cup 140 has an interior cavity 141 for receiving and enclosing at least a portion of the power charge 120. The cup 140 generally aligns the power charge 120 with a longitudinal axis 132 of the upper sub 110 and centers the power charge 120 in the second chamber 116.

The input end 136 also includes a plurality of passages 142 that extend between an outer surface 144 of the input end 136 to a longitudinal bore 146. The passages 142 are the only paths of fluid communication at the input end 136 with the longitudinal bore 146. Thus, gas from the second chamber 116 first flows along an annular flow space 121 formed by the outer surface of the cup 144 and an inner surface of the housing 112. This annular flow space 121 may act as a preliminary filter. Thereafter, the gas flows through the passages 142 and converges into the bore 146, which directs the gas to the output end 138. In one arrangement, the passages 142 circumferentially distributed around and radiate in a spoke-like fashion from the bore 146 at an acute angle relative to the longitudinal axis 132. In embodiments, the diameter of the passages 142 is smaller than the diameter of the longitudinal bore 146. In embodiments, the inlets of the passages 142 are formed on an outer circumferential surface defining the cup 140.

The input end 136 and the output end 138 may each include threads or other fastening features to connect with the upper sub 110 and the lower sub 160, respectively. Additionally, seals may be used at the connections to ensure a sealed and fluid-tight environment for the bore 146.

Referring now to FIG. 1B, the second sub 160 uses the gas to energize one or more piston assemblies to energize the actuator 162. By "energize," it is meant the gas furnishes the energy required for the actuator 162 to perform one or more predetermined tasks. In the non-limiting arrangement shown, the second sub 160 has two piston assemblies that move in unison: a first piston assembly 164 and a second piston assembly 166. The first piston assembly 164 includes a housing 168, a shaft assembly 170, and a piston 172. The shaft assembly 170 includes a first end 174, a flow passage 178, and a face 180. The first end 174 is received into the gas transfer sub bore 146 (FIG. 1A) of the body 134 (FIG. 1A) such that the gas transfer sub bore 146 and the flow passage 178 are in fluid communication. The flow passage 178 extends fully through the shaft assembly 170 and terminates at a cavity 184 formed at a second end 186 of the shaft assembly 170. A pressure chamber 182 formed between the face 180 and the piston 172 receives the gas via the flow passage 178.

Similarly, the second piston assembly 166 includes a housing 188, a shaft assembly 190, and a piston 192. The shaft assembly 190 includes a first end 194 that is received into the cavity 184 of the shaft assembly 170, a flow passage 196, and a face 198. A pressure chamber 200 formed between the face 198 and the piston 192 receives the gas via the flow passage 196. The actuator 162 may be connected to a second end 202 of the shaft assembly 190. The actuator 162 has a distal end that can connect to the separate work piece (not shown). The housing 188 connects to a movable component 199 of the separate work piece (not shown)

Figure 3:
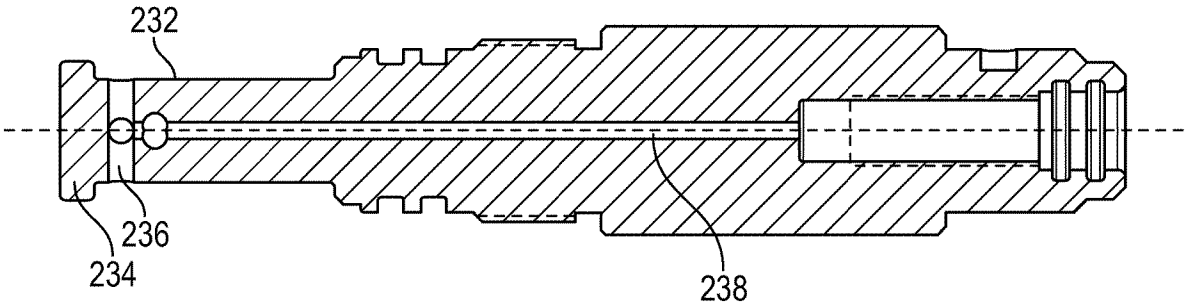
FIG. 3 is a sectional side view of a gas transfer sub in accordance with another embodiment of the present disclosure.

Referring now to FIG. 3, there is shown another embodiment of a flow transfer sub 130. In this embodiment, an input end 232 has a pedestal 234 and orthogonal passages 236 radiating outward from a central bore 238. The power charge 120 (FIG. 1A) seats on but is not retained by the pedestal 234. In a manner previously described, the orthogonal passages 236 filter the gas generated by the power charge 120 (FIG. 1A). In embodiments, the inlets of the passages 236 are formed on an outer circumferential surface defining the input end 232.

Figure 4:
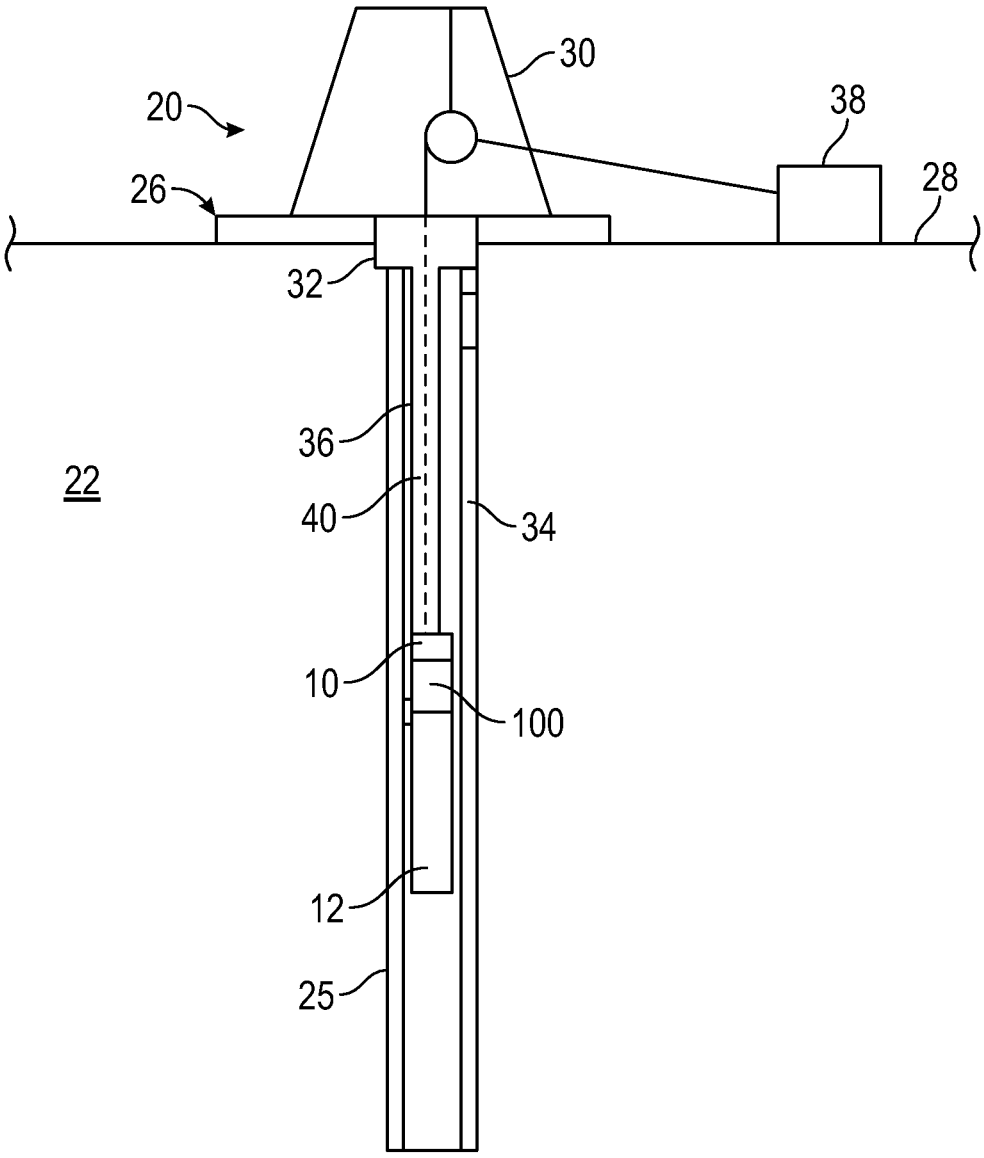
FIG. 4 depicts an elevation view of a well using a well tool in accordance with one embodiment of the present disclosure.

Referring to FIG. 4, there is shown a well construction and/or hydrocarbon production facility 20 positioned over a subterranean formation of interest 22. A gas activated well tool 100 made in accordance with the present disclosure may be used to perform one or more predetermined downhole tasks in a wellbore 25 that intersects the formation 22. The facility 20 can include known equipment and structures such as a platform 26 at the earth's surface 28, a rig 30, a wellhead 32, and cased or uncased pipe/tubing 34. A work string 36 is suspended within the wellbore 25 from the platform 26. The work string 36 can include drill pipe, coiled tubing, wire line, slick line, or any other known conveyance means. The work string 36 can include telemetry lines or other signal/power transmission mediums that establish one-way or two-way telemetric communication from the surface to the downhole tool 100 connected to an end of the work string 36. For brevity, a telemetry system having a surface controller (e.g., a power source) 38 adapted to transmit electrical signals via a cable or signal transmission line 40 disposed in the work string 36 is shown.

As used above, the word "deflagration" refers to a process where an energetic material does not generate a shock wave when ignited.

In one method of operation, the well tool 100 is conveyed into the wellbore 25 using the work string 36. After being positioned as desired, a suitable signal is transmitted to detonate the igniter 118. In one non-limiting arrangement, an electrical signal is conveyed via the cable 40. Alternatively, a pressure increase or drop bar may be used. The igniter 118 generates a flame output that ignites the power charge 120. The power charge 120 undergoes a low order deflagration that generates a high-pressure gas. Solid or semi-solid debris may also be formed during the low order-deflagration. The gas flows parallel with the longitudinal axis 132 along the second chamber 116 and the annular flow space 121 and then flows radially inward into the flow passages 142. The flow passages act as filters that prevent debris above a predetermined size from entering the longitudinal bore 146. The high-pressure gas flows via the longitudinal bore 146 to the first pressure chamber 182 and also via the longitudinal bore 196 to the second pressure chamber 200.

When the pressures in the chambers 182, 200 are sufficiently high, the pistons 172, 192 are displaced in the direction shown by arrows 197. Thus, the housings 168, 188 are also displaced in a similar direction. The distal end 162 is fixed to the separate work piece (not shown). Thus, the shaft assemblies 170, 190 hold the well tool 100 stationary relative to portion of the separate work piece (not shown) that must stay stationary while the movable portion 199 is axially displaced by the housing 188. It is the axial movement of the movable portion 199 that activates the separate well tool (not shown). It should be appreciated that the gas supplied to the pressure chambers 182, 200 have a reduced content of debris, which correspondingly reduces the risk that the various passages and bores conveying the gas become obstructed.

It should also be appreciated the FIGS. 1A-B embodiment also reduces the risk of liquid debris entering the bores and passages. For example, referring to FIG. 1A, when the well tool 100 approaches a horizontal orientation, liquid debris will collect in a tool low side 195 and resist flowing in the longitudinal bore 146. This is due to the longitudinal bore 146 being at a higher elevation than the tool low side 195. Also, for orientations of well tool 100 approaching a vertical, the cup 140 can retain and capture liquid debris.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. Thus, it is intended that the following claims be interpreted to embrace all such modifications and changes.

We claim:

1. An apparatus for activating a wellbore tool, comprising:
- a first sub having a first chamber in fluid communication with a second chamber;
- a igniter disposed in the first chamber, the igniter generating a flame output when ignited;
- a power charge disposed in the second chamber, the power charge generating a high pressure gas when ignited by the flame output;
- a gas transfer sub connectable with the first sub, the gas transfer sub having:
  - a first end receiving a portion of the power charge,
  - a longitudinal bore, and
  - a plurality of flow passages radiating from the longitudinal bore, each flow passage having an inlet formed on an outer circumferential surface defining the first end, the plurality of flow passages providing the only fluid communication between the longitudinal bore and the second chamber of the first sub; and
- a second sub connectable with the gas transfer sub, the second sub including:
  - a shaft having a first end connectable with the gas transfer sub, the shaft including: a passage in fluid communication with the longitudinal bore of the gas transfer sub and a face, and
  - a piston positioned adjacent to the face, wherein a pressure chamber is formed between the shaft face and the piston is in fluid communication with the passage of the shaft.

2. The apparatus of claim 1, wherein the plurality of flow passages radiate orthogonally from the longitudinal bore.

3. The apparatus of claim 1, wherein the first end of the gas transfer sub includes a cup extending from the first end and into the second chamber and enclosing the portion of the power charge.

4. The apparatus of claim 3, wherein the cup forms an annular flow space between an outer surface of the cup and an inner surface of the second chamber, the annular flow space terminating at the inlets of the plurality of passages.

5. The apparatus of claim 3, wherein the cup is defined by the circumferential surface and wherein each inlet of each passage is formed on the circumferential surface.

6. The apparatus of claim 3, wherein the plurality of flow passages filter a liquid debris caused by the ignited power charge when the first sub and the gas transfer sub approach a horizontal orientation.

7. The apparatus of claim 3, wherein the cup retains a liquid debris caused by the ignited power charge when the first sub and the gas transfer sub approach a vertical orientation.

8. The apparatus of claim 1, wherein the first end of the gas transfer sub includes a pedestal that seats the portion of the power charge.

9. An apparatus for activating a wellbore tool, comprising:
- a first sub having a first chamber and a second chamber;
- a igniter disposed in the first chamber, the igniter generating a flame output when ignited;
- a power charge disposed in the second chamber, power charge generating a high pressure gas ignited by the flame output;
- a gas transfer sub connectable with the first sub, the gas transfer sub having:
  - a first end receiving a portion of the power charge,
  - a longitudinal bore,
  - a plurality of flow passages radiating at an acute angle from the longitudinal bore, the plurality of flow passages providing fluid communication between the longitudinal bore and the second chamber of the first sub;
  - a cup extending from the first end into the second chamber and enclosing the portion of the power charge, wherein an annular flow space separates an outer surface of the cup and an inner surface of the second chamber, the annular flow space terminating at the plurality of passages, wherein the cup is defined by a circumferential surface and wherein an inlet of each passage is formed on the circumferential surface, wherein the annular flow space and the plurality of flow passages are arranged to filter the high pressure gas; and
- a second sub connectable with the gas transfer sub, the second sub having a first and a second piston assembly, wherein the first piston assembly includes:
  - a first shaft having a first end mateable with the gas transfer sub, the second shaft including a passage in fluid communication with the longitudinal bore of the gas transfer sub and a face, and
  - a first piston positioned adjacent to the first shaft face, wherein a pressure chamber is formed between the first shaft face and the first piston is in fluid communication with the passage of the first shaft; and wherein the second piston assembly includes:
  - a second shaft having a first end mateable with the first shaft, the second shaft including a passage in fluid communication with the passage of the first shaft and a face, and
  - a second piston positioned adjacent to the second shaft face, wherein a pressure chamber is formed between the second shaft face and the second piston is in fluid communication with the passage of the second shaft.

10. The apparatus of claim 9, wherein the plurality of flow passages provide the only fluid communication between the longitudinal bore and the second chamber of the first sub.

* * * * *